US006470308B1

(12) United States Patent
Ma et al.

(10) Patent No.: US 6,470,308 B1
(45) Date of Patent: Oct. 22, 2002

(54) HUMAN SPEECH PROCESSING APPARATUS FOR DETECTING INSTANTS OF GLOTTAL CLOSURE

(75) Inventors: Chang X. Ma; Leonardus F. Willems, both of Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1513 days.

(21) Appl. No.: 08/869,020

(22) Filed: Jun. 4, 1997

Related U.S. Application Data

(63) Continuation of application No. 08/557,370, filed on Nov. 13, 1995, which is a continuation of application No. 07/948, 186, filed on Sep. 21, 1992.

(30) Foreign Application Priority Data

Sep. 20, 1991 (EP) ..... 91202437

(51) Int. Cl.[7] ..... G10L 19/00
(52) U.S. Cl. ..... 704/201
(58) Field of Search ..... 395/2.19, 2.2, 395/2.4, 2.67, 2.7

(56) References Cited

U.S. PATENT DOCUMENTS 3,511,932 A * 5/1970 Flanagan ..... 381/53
3,770,892 A * 11/1973 Clapper ..... 395/2.6
3,940,565 A 2/1976 Lindenberg ..... 395/2.62
4,561,102 A * 12/1985 Prezas ..... 395/2.16
4,809,331 A * 2/1989 Holmes ..... 395/2.4
4,862,503 A * 8/1989 Rothenberg ..... 395/2.44
5,091,948 A * 2/1992 Kanetani ..... 395/2.57
5,479,564 A * 12/1995 Vogten et al. ..... 395/2.76

OTHER PUBLICATIONS

Wood Et Al, "Excitation Synchronous Formant Analysis", IEE Proceedings, vol. 136, PT.I, No. 2, Apr. 1989 Pp 110–118.*

* cited by examiner

*Primary Examiner*—Richemond Dorvil
*Assistant Examiner*—Michael N. Opsasnick
(74) *Attorney, Agent, or Firm*—Steven R. Biren

(57) ABSTRACT

In the natural production of human speech, the instant of closure of the vocal cords occurs usually at well defined instants. These instants are used for speech processing, such as glottal synchronous processing or speech synthesis with observed natural vocal cord excitation signals. To detect the instants of glottal closure from an observed speech signal, the observed speech signal is high pass filtered, and a temporally localized aggregate of the number and amplitudes of peaks in the high pass filtered signal is determined for possible instants of glottal closure. The instants of glottal closure are determined as instants where the aggregate takes maximal values.

11 Claims, 4 Drawing Sheets

HUMAN SPEECH PROCESSING APPARATUS FOR DETECTING INSTANTS OF GLOTTAL CLOSURE

This is a continuation of application Ser. No. 08/557,370, filed Nov. 13, 1995, which is a continuation of application Ser. No. 07/948,186, filed Sep. 21, 1992

BACKGROUND OF THE INVENTION

The invention relates to a speech signal processing apparatus, comprising detecting means for selectively detecting a sequence of time instants of glottal closure, by determining specific peaks of a time dependent intensity of a speech signal.

Glottal closure, that is, closure of the vocal cords, usually occurs at sharply defined instants in the human speech production process. Knowledge where such instants occur can be used in many speech processing applications. For example, in speech analysis, processing of the signal is often performed in successive time frames, each in the same fixed temporal relation to a respective instant of glottal closure. In this way, the effect of glottal closure upon the signal is more or less independent of the time frame, and differences between frames will be largely due to the change in time of the parameters of the vocal tract. In another application example, a train of glottal excitation signals is fed through a synthetic filter modelling the vocal tract in order to produce synthetic speech. To produce high quality speech, glottal excitations derived from physical speech are used to generate the glottal excitation signal.

For such applications, it is desirable to identify the instants of glottal closure from physically received human speech signals. An apparatus for finding these instants, or at least instants which stand in fixed phase relation to these instants is known from U.S. Pat. No. 3,940,565. According to this publication, the instant of glottal closure is identified as an instant of maximum amplitude in the signal. To detect this, the received speech signal is fed to a peak detector, and when the resulting peak signal is sufficiently large this detector triggers a flipflop to signal glottal closure.

The disadvantage of this method is that in not all speech signals glottal closure corresponds to the largest peak or even to a single peak. In voiced signals, there may be several peaks distributed over one period which may give rise to false detections. Also there may be several comparably large peaks surrounding each instant of glottal closure, which gives rise to jitter in the detected instants as the maximum jumps from one peak to another. Moreover in unvoiced signals no instants of glottal closure are present, but there are many irregularly spaced peaks, which give rise to false detection.

SUMMARY OF THE INVENTION

It is an object of the invention to improve the robustness of glottal closure detection without requiring complex processing operations.

In an embodiment, the invention realizes the objective because it is characterized in that the apparatus includes

- a filter, for forming from the speech signal a filtered signal, through deemphasis of a spectral fraction below a predetermined frequency, the filter then feeds the filtered signal an
- averaging mechanism which generates through averaging in successive time windows, a time stream of averages representing said time dependent intensity of the speech signal.

In this apparatus, the physical speech signal is first filtered using a high pass or band pass filter which emphasizes frequencies well above the repetition rate of glottal closure. The filtering will emphasize the short term effects of glottal closure over longer term signal development which is due mainly to ringing in the vocal tract after glottal closure. However, in itself the filtering usually will not give rise to a single peak, corresponding to the instant of glottal closure. On the contrary, it will increase the relative contribution of noise peaks, and moreover the effect of glottal closure itself is often distributed over several peaks, an effect which can be worsened by the occurrence of short term echoes.

We have found that near the instant of glottal closure, there will usually be a large peak or many small peaks, both of which correspond to a large local signal density, i.e. aggregate peak number/amplitude count. Therefore, instead of containing only detection means for signal peaks, the apparatus comprises averaging means which determine the signal intensity by averaging contributions from successive windows of time instants. Consequently each instant of glottal closure will correspond to a single peak in the physical intensity, and for example the instant when the peak value is reached or the the center of the peak will have a time relation to the instant of glottal closure which is independent of the details of the speech signal.

In an embodiment of an apparatus according to the invention, characterized, in that the filtering means are arranged for feeding the filtered signal to the averaging means via rectifying means, for rectifying the filtered signal, through value to value conversion, into a strength signal. By rectifying is meant the process of obtaining a signal with a DC component which is responsive to the amplitude of an AC signal, in this case the strength signal from the filtered signal. A simple example of a rectifying value to value conversion is the conversion of filtered signal values to their respective absolute values. In general, any conversion in which values of opposite sign do not consistently yield exactly opposite converted values qualifies as rectifying, provided values with successively larger amplitudes are converted to converted values with successively larger amplitudes at least in some value range. Examples of rectifying conversions in this sense are taking the exponential of the signal, any power of its absolute value or linear combinations thereof.

One embodiment of the apparatus according to the invention is characterized, in that the conversion comprises squaring of values of the filtered signal. In this way, the DC component of the strength signal, i.e. the physical intensity, represents the energy density of the signal, which will give rise to optimal detection if the peaks amplitudes are normally distributed in the statistical sense.

In an embodiment of the apparatus according to the invention characterized, in that, in said averaging, the strength signal is weighted in each of the windows, with weighting coefficients which remain constant as a function of time distance from a centre of the window up to a predetermined distance, and from the predetermined distance monotonously decrease to zero at the edge of the window. A set of weighting coefficients which gradually decreases at the edges of the window mitigates the suddeness of the onset of contribution due to peaks in the filtered signal; this makes the onset of peaks in the physical intensity less susceptible to individual peaks in the filtered signal if this contains several peaks for one instant of glottal closure.

The precise temporal extent of the windows is not critical. However, if the windows are so wide as to encompass more than one successive instant of glottal closure, there will be contributions to the average which do not belong to a single instant of glottal closure and a poorer signal to noise ratio will generally occur in the intensity. To avoid overlap of contributions from neighboring instants of glottal closure, the extent should be made shorter than the time interval between neighboring instants of glottal closure, which for male voices is in the range of 8 to 10 msec and for female voices is in the range of 4 to 5 msec. Too small an extent incurs a risk of multiple detections, which is reduced as the extent is increased. Depending on the quality of the physical speech signal a minimum extent upward of 1 msec has been found practical; an extent of 3 msec was a good tradeoff for both male and female voices.

In one embodiment of the apparatus, characterized, in that it comprises width setting means, for setting a temporal width of the windows according to a pitch of the speech signal. The width setting means use a prior estimate of the pitch, i.e. the interval between neighboring instants of glottal closure, to restrict the temporal extent of the window to below this interval. The prior estimate may be obtained in any one of several ways, for example by feeding back an average of the interval lengths between earlier detected instants of glottal closure, or using a separate pitch estimator, or by using a user control selector etcetera. Since the most significant pitch differences are between male and female voices, a male/female voice selection button may be used for selecting from one of two extents for the window. Accordingly, an embodiment of apparatus according to the invention is characterized, in that the setting means are arranged for setting the temporal width to a first or second extent, the first extent lying between 1 and 5 milliseconds and the second extent lying between 5 and 10 milliseconds.

In an embodiment of the apparatus according to the invention characterized, in that the filtering means copy a further spectral fraction of the speech signal above 1 kHz substantially indiscriminately into the filtered signal. This makes the filtering means easy to implement. For example, when the physical speech signal is a sampled signal, with 10 kilosamples per second, samples $I_n$ being identified by a sample time index "n", the expression $$s_n = I_n - 0.9 I_{n-1}$$

gives a satisfactory way of producing a filter signal $s_n$.

The detection of the instants of glottal closure may be performed by locating locally maximal intensity values, or simply by detecting when the physical intensity crosses a threshold, or by measuring the centre position of peaks. In an embodiment of the apparatus according to the invention detection is accomplished by determining an average DC content of the strength signal, averaged over a temporal extent wider than the width of the windows, then, for determining whether the time dependent intensity exceeds the average DC content by more than a predetermined factor, excesses corresponding to the specific peaks. In this way, the thresholds are set automatically and are robust against variations in the nature of the signal. When the predetermined factor is set sufficiently high, unvoiced signals will not lead to detection of any instants of glottal closure.

In an embodiment of the apparatus according to the invention characterized, in that the detection systems feed a synchronization input of frame by frame speech analysis mechanism, for controlling positions of frames during analysis of the physical speech signal.

In an embodiment of the apparatus according to the invention characterized, in that the detection mechanism feed an excitation input of a vocal tract simulator, for forming a synthesized speech signal.

BRIEF DESCRIPTION OF THE DRAWINGS

For a fuller understanding of the invention, reference is had to the following description taken in connection with the accompanying drawings, in which.

GLOTTAL CLOSURE AND ITS DETECTION

Figure 1:
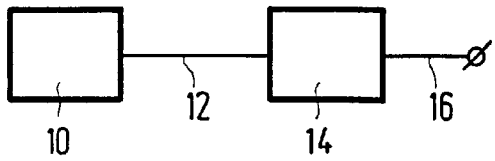
FIG. 1 depicts a conventional model of speech production

FIG. 1 depicts a conventional model for the physical production of voiced human speech. According to this model, the vocal cords 10 produce a locally periodic train of excitations, which is fed 12 through the vocal tract 14, which effects a linear filter operation upon the train of excitations. The repetition frequency of the excitations, the "pitch" of the speech signal is usually in the range of 100 Hz to 250 Hz. The train of excitations has a spectrum of peaks separated by intervals corresponding to this frequency, the amplitude of the peaks varying slowly with frequency and disappearing only well into the kHz range. The linear filtering of the vocal tract on the other hand has a strong frequency dependence below 1 khz, often with pronounced peaks; especially at lower frequencies the spectral shape of the speech signal at the output 16 is therefore determined by the vocal tract.

Physical excitations produced by the vocal cords 10, have been found to have well defined instants of so called glottal closure. These are periodic instants where the vocal cords close, after which the vocal tract filter 14 is left to develop the output signal by itself through ringing. Detection of these instants of glottal closure is used for various purposes in electronic speech processing.

In one example of the use of these instants, speech is synthesized using an electronic equivalent of FIG. 1, with an excitation generation circuit 10 followed by a linear filter. In order to produce high quality synthetic speech, the excitation generation circuit is arranged to generate a train of excitations with natural irregularities; for this purpose observed instants of glottal closure are used.

Figure 2:
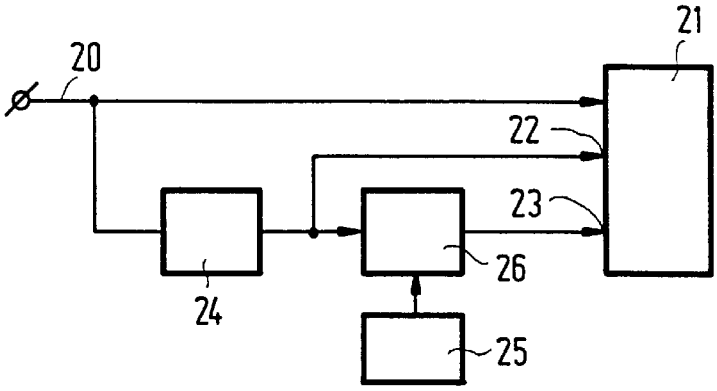
FIG. 2 shows an apparatus for frame by frame speech analysis

In another example, speech analysis, i.e. the decomposition of speech, is performed on a frame by frame basis, a frame being a part the speech signal between two time points; the time points are synchronized by the instant of glottal closure. FIG. 2 shows an example of a speech analysis apparatus that works on this principle. At the input 20, the speech signal is received. It is processed in a processing circuit 21, which apart from the speech signal also receives a frame start signal 22, and an intra frame position pointer 23. Processing by the processing circuit is periodic, the period being reset by the reset input, and the position within the period being determined from the position pointer. The reset input is controlled by a glottal closure detection circuit 24, which detects instants of glottal closure by analysis of the speech signal received at the input 20. The glottal closure detection circuit 24 also resets a counter 26, driven by a clock 25, which in the exemplary apparatus generates the intra frame pointer. One advantage of frame by frame processing is that there is a fixed relation between the phase of glottal excitation and the position in the frame, whereby many of the effects of excitation of the vocal cords are independent of the particular window considered. Therefore the signal variation between windows is dominated by the effects of the vocal tract.

Figure 3:
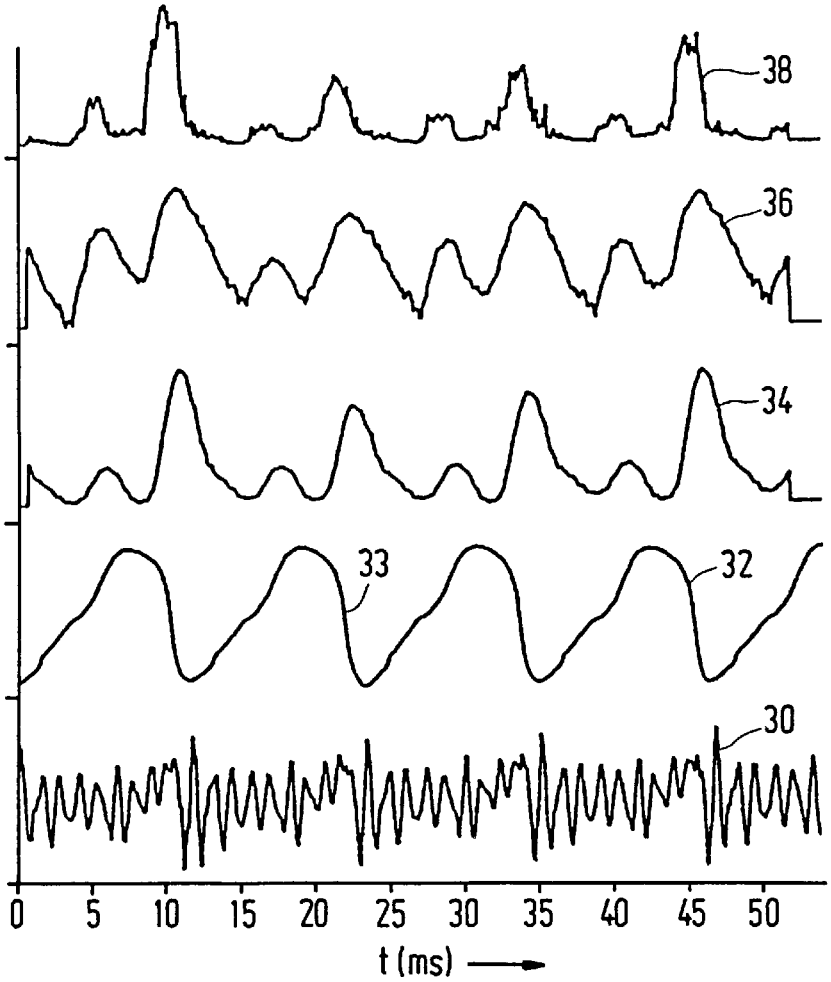
FIG. 3 shows a speech signal, an electroglottal signal and three signals obtained by processing the speech signal

FIG. 3 shows an example of an electroglottal waveform 32 obtained by electrophysiological measurement, the speech signal 30 produced from it, and the results 34, 36, 38 of processing the speech signal. The electroglottal waveform 32 has a very strong derivative at periodic instants (e.g. 33). These are the instants of glottal closure, and it is an object of the invention to determine these instants form the speech signal 30. As a first step in attaining the object, the speech signal 30 is converted into a filtered signal by linear high pass filtering. As the order in which linear operations are applied to a signal is immaterial for the result, one may consider the combined effect of the high pass filtering and the vocal tract filter 14 as the result of applying the vocal tract filter 14 to a high pass filtered version of the electroglottal waveform. This version will have a constant value most of the time, with sharp peaks at instants of glottal closure 33. Between the peaks, the development of the high pass filtered speech signal is only determined by the vocal tract filter 14, which means that successive high pass filtered speech signal values should be linearly predictable from preceding values, with more or less time invariant prediction coefficients.

At the peaks, this prediction will be incorrect. Detection of instants of glottal closure is attained by analyzing the amount of deviation that occurs in linear prediction. For this purpose, it is not necessary to determine the actual prediction coefficients; an analysis of the correlation matrix "R", of samples of the signal, is sufficient. This correlation matrix "R" is defined in terms of successive speech samples $S_i$ $$R_{ij}=\Sigma_{n=1..m}S_{i+n}S_{j+n}$$

The matrix indices i,j run over a predetermined range of "p" samples. The length of this range is called the order of the matrix, a reference for the position of the range in time is called the instant of analysis. The constant "m" is called the length of an analysis interval over which the correlation values are determined. When the speech samples "s" are linearly predictable from their predecessors, the matrix R will have at least one eigenvalue equal to zero. In general, all eigenvalues of R will be real and greater than or equal to zero, and when the speech samples "s" are not exactly linearly predictable, due to noise, or inaccuracies in the model presented in FIG. 1, the smallest eigenvalue of R will at least be near zero.

One can use this property of the correlation matrix R to detect the amount of deviation from linear predictability, for example by evaluating the determinant (which is equal to the product of the eigenvalues, and will be small if the smallest eigenvalue is near zero), or, in another example, by determining the smallest eigenvalue. The logarithm of the determinant 36 and the smallest eigenvalue 38 are displayed in FIG. 3 versus the instant in time at which they are determined. They were determined by sampling the filtered speech signal "I" at a rate of 10 kHz, subjecting the sampled values to the following high pass filter in order to obtain the filtered values "s"

$$S_n=I_n-0.9I_{n-1}$$

The analysis interval length in obtaining FIG. 3 was m=30 samples and order of the matrix was p=10. It can be seen that both the logarithm of the determinant 36 and the smallest eigenvalue 38 exhibit marked peaks at the instants of glottal closure, i.e. parts of the electroglottal waveform 32 with steep slopes.

However, determination of either the determinant or the smallest eigenvalue of a matrix require a substantial amount of computation. We have found that a similar and at least as robust a detection of the instant of glottal closure can be attained by evaluating the sum of the diagonal elements of the correlation matrix R, i.e. its trace, which is equal to the sum of its eigenvalues; experiment has shown that all eigenvalues of the correlation matrix exhibit marked peaks near the instants of glottal closure. Evaluation of the trace, however, is a much simpler operation than either determining the determinant of the smallest eigenvalue: it comes down to a weighted sum of the squares of the signal values, where the weight coefficients have a symmetrical trapezoidal shape as a function of time, the shape having a base width of m+p and a top width of m−p.

Figure 4:
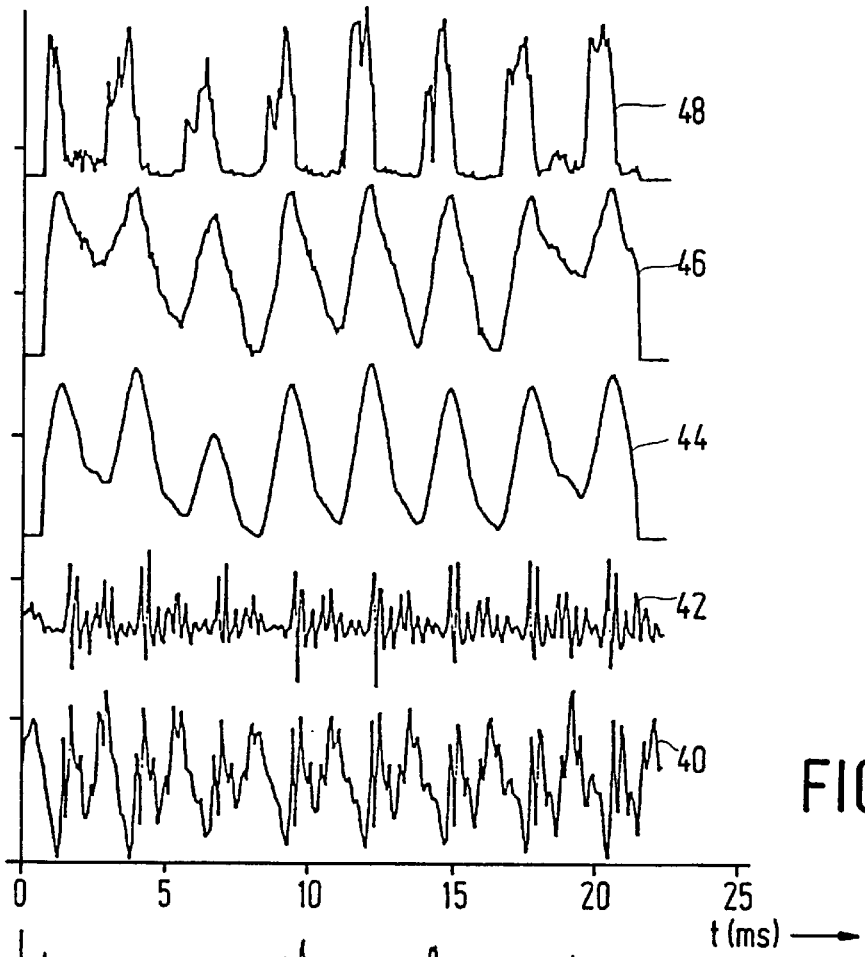
FIG. 4 shows further examples of processing results FIG. 5 also shows further examples of processing results
Figure 5:
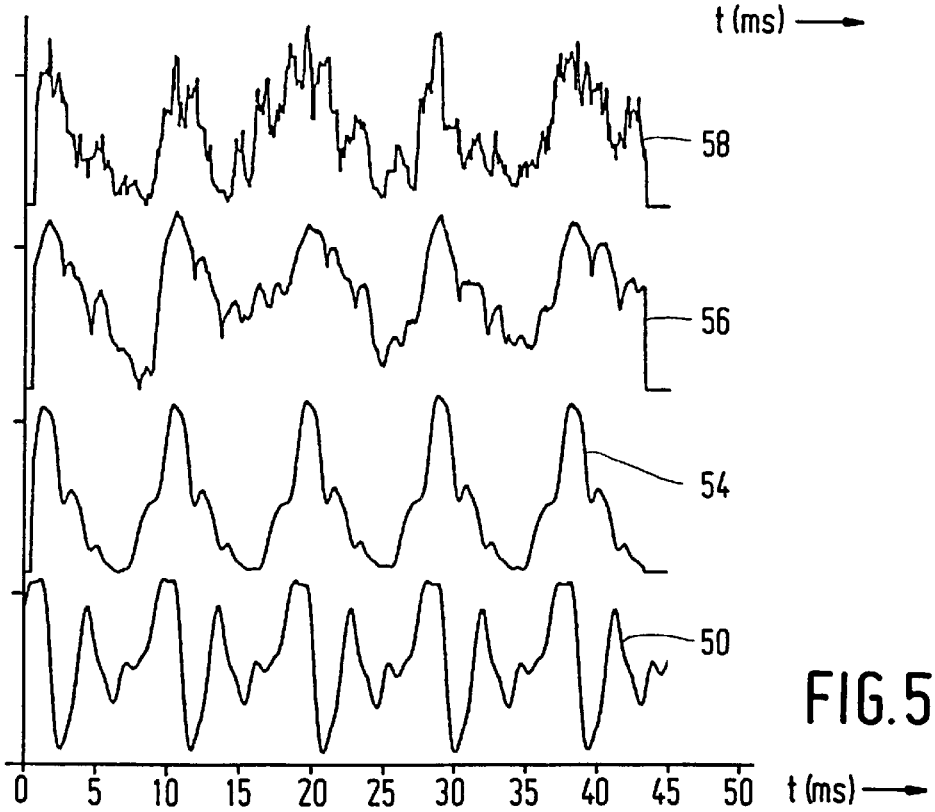
Figure 6:
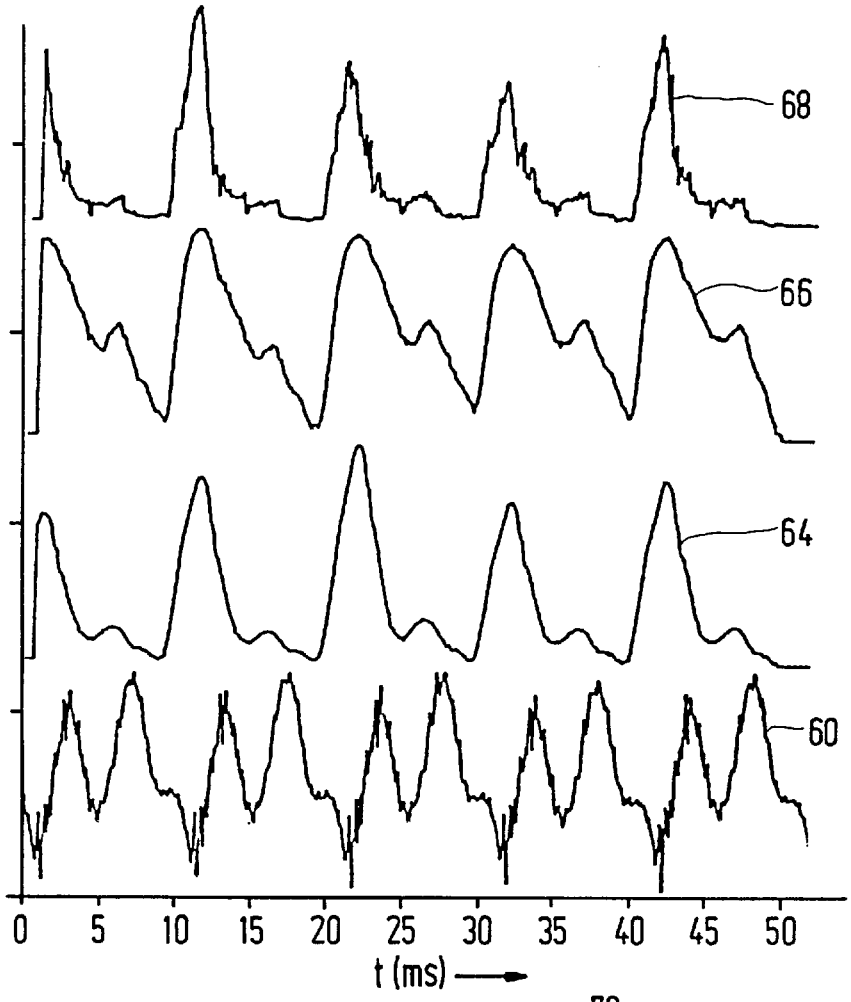
FIG. 6 shows additional examples of processing results.

The result of evaluating the trace of the correlation matrix is plotted versus the instant of analysis in the third curve 34 of FIG. 3. It will be seen that this curve also exhibits marked peaks near the instants of glottal closure. Further examples of processing results are given in FIGS. 4, 5 and 6, which illustrate various speech signals 40, 50, 60, the result of evaluating the smallest eigenvalue 46, 56, 66, the logarithm of the determinant 48, 58, 68 and the trace of the correlation matrix 44, 54, 64 as a function of the instant of analysis. FIG. 4 also contains the result 42 of filtering signal 40 with a high pass filter. One should note that in FIG. 3 the instant of glottal closure coincides with the maximum speech signal amplitude, and in FIG. 5 it coincides with maximum signal derivative. This is by no means always the case; in many speech signals there are several peaks in either the signal or its derivative or both, and the instant of glottal closure often does not coincide with these peaks; FIGS. 4 and 6 provide illustrations of this. In FIG. 6, the highest peaks have little or no high frequency content and do not give rise to larger detection signals 64. In FIG. 4, there are three peaks in the high pass filtered signal near each instant of glottal closure, and the maximum amplitude occurs variably either at the first second or third peak. It will be clear that mere maximum detection in this case would lead to phase jitter in the detection of instants of glottal closure, whereas the trace signal 44 provides a robust detection signal.

Figure 7:
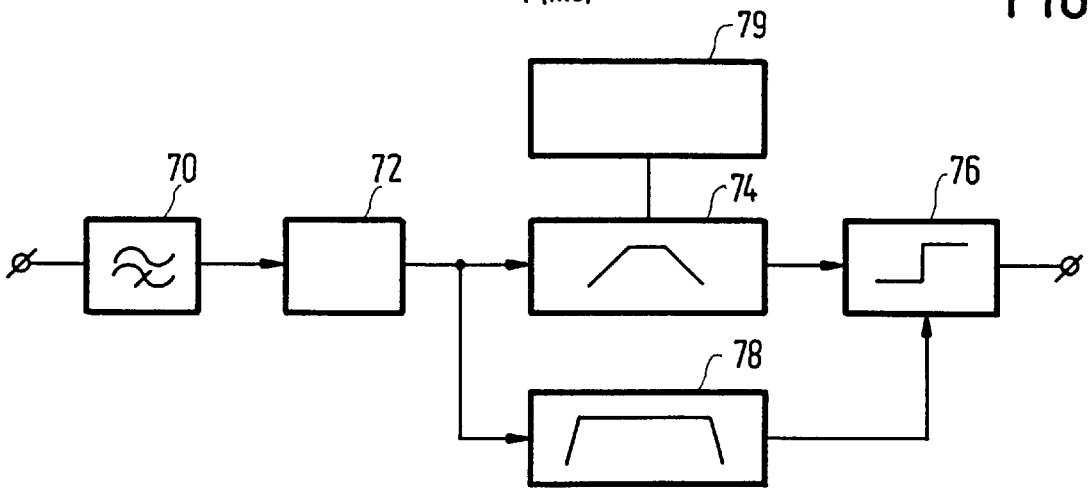
FIG. 7 shows an exemplary detector according to the invention for detecting instants of glottal closure by analysis of a speech signal

Hence, we have found that the trace of the correlation matrix is a computationally simple and robust way of marking instants of glottal closure. An exemplary apparatus detecting instant of glottal closure is shown in FIG. 7. Here the speech signal arriving at the input is filtered in a high pass filter 70, and then squared in the signal converter 72, subsequently, it is filtered with averaging means 74 which weights the signal in a window with a finite trapezoidally shaped impulse response (analysis of the expression for the correlation matrix shows that this is equivalent to trace determination). Preferably the extent of the impulse response should be less than the distance between successive instants of glottal closure. After the integrator 74, the signal is tresholded in a threshold detection circuit 76 which selects the largest output values as indicating glottal closure, but with a time delay relative to the input speech signal due to the impulse delay of the averaging means 74. In the example shown in FIG. 7, the threshold is fed to the thresholding circuit via a further averaging circuit 58, which determines the average converted signal amplitude over a wider interval than the window of the averaging means 74.

Figure 8:
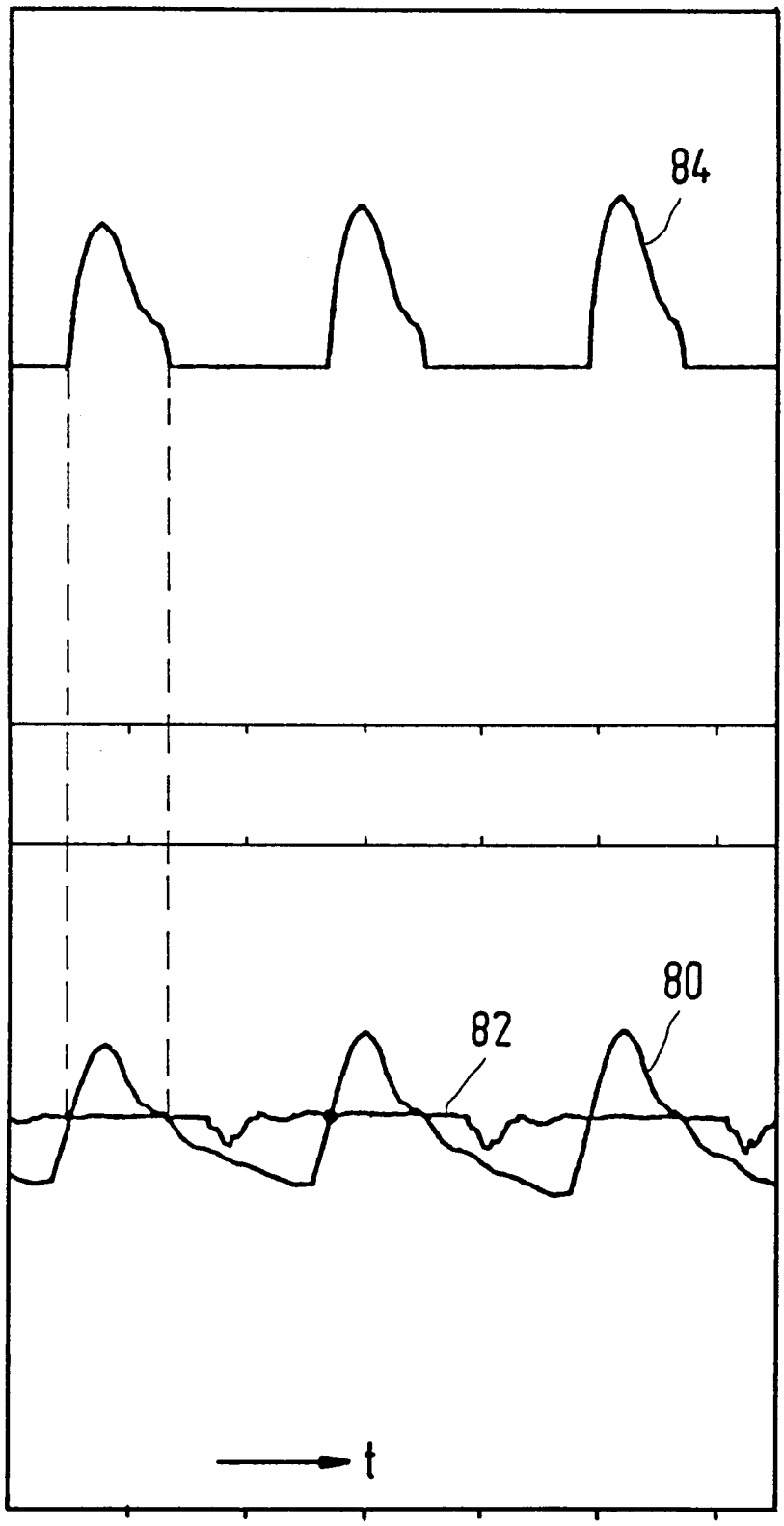
FIG. 8 shows the results of a thresholding operation to detect instants of glottal closure

The output of the circuit is illustrated in FIG. 8, where the output 80 of the averaging means 74 is shown, together with the result 82 of further averaging 78, and thresholding with the further average 84.

The effectiveness of the apparatus shown in FIG. 7 can also be understood without reference to the mathematical analysis expounded above. Near the instant of glottal closure, the excitation signal at the point 12 in FIG. 1 contains strong high frequency components. By using the high pass filter 70, these components are emphasized. They are then rectified by squaring them in the rectifier 72, and their density, or signal energy, is measured in the averaging means 74 which thus gets maximum output at the instant of glottal closure.

From this understanding of the effect of the apparatus, a number of variations in the apparatus which will leave it equally effective are readily derived. To begin with, the high pass filter 70 may be replaced with any filter (like a band pass filter) that selectively passes higher frequency components which are chiefly attributed to the sharp variation of the excitation signal near the instant of glottal closure.

Furthermore, the rectifier 72, which in the mathematical analysis used squaring of the signal may be replaced with any nonlinear conversion, like for example taking power unequal to two or the exponent of the filtered signal. The only condition is that the nonlinear operation generates a DC bias from an AC signal, which grows as the AC amplitude grows. A necessary and sufficient condition for this is that the nonlinear operation is not purely uneven (assigns opposite output values to opposite filtered signal values), and grows with amplitude. The nonlinear conversion can be performed by performing actual calculation of a conversion function (like squaring), but in many cases, a lookup table, containing converted values for a series of input values can be used.

The function of the averaging means 74 is to collect contributions from around the instant of glottal closure, and to distinguish this collection from the contributions collected around other instants. For this purpose, it suffices that averaging extends over less than the full distance between successive instants of glottal closure; the average may be weighted, most weight being given to instants close to the instant under analysis.

The maximum extent of the window must be estimated in advance. This can be done once and for all, by taking the minimum distance that occurs for normal voices, which is about 3 msec. Alternatively, one provide selection means 79 to adapt the integrator window length to the speaker, for example by using feedback from the observed distance between instants of glottal closure, or using an independent pitch estimate (the pitch being the average frequency of glottal closure). Another possibility is use of a male/female switch button in the selection means 79, which allows the user to select a filter extent corresponding either to typical female voices (distance between instants of glottal closure above 4 msec) or to male voices (above 8 msec).

The trapezoidal shape of the weighting profile of the averaging means 74, which was derived using the trace of the correlation matrix, is not critical and variations in the profile are acceptable, provided it has weighting values which substantially all have the same sign, and decrease in amplitude from a central position of the window. The width of the window defines the delay time of the averaging means 74; in general, the peaks at the output of the averaging means 74 will be delayed with respect to the instants of glottal closure by an interval equal to half the window width.

Finally, the extraction of the instants of glottal closure from the integrator signal can also be varied. For example, one may use a fixed threshold, or an average threshold as in FIG. 7, but the average may be multiplied by a predetermined factor in order to make the threshold more or less stringent. Furthermore, instead of thresholding, one may select maxima, i.e. instants of zero derivative, possibly in combination with thresholding.

Although the apparatus as described hereinbefore used separate components, processing sampled signals, it will be clear that the invention is not limited to this: it can be applied equally well to continuous (non sampled signals), or the processing can be performed by a single computer executing the several processing operations.

What is claimed is:

1. An apparatus for processing a speech signal comprising:

a filter for receiving said speech signal and for generating a filtered speech signal by deemphasizing a spectral fraction of said speech signal below a predetermined frequency;

an averaging circuit coupled to said filter for receiving the filtered speech signal and generating, through averaging in successive time windows, a time stream of average signal corresponding to time dependent intensity of said speech signal; and a detector for selectively detecting a sequence of time instants of glottal closure by determining peaks of said time dependent intensity of said speech signal.

2. The apparatus of claim 1, further including a rectifier coupled between said filter and said averaging circuit for rectifying said filtered speech signal received by the average circuit, through a value to value conversion, the rectified speech signal being a strength signal.

3. The apparatus as claimed in claim 2, wherein said rectifier squares the values of said filtered speech signal.

4. The apparatus as claimed in claim 3, wherein said averaging circuit weights said strength signal in each of said time windows with weighting coefficients which are constant as a function of time distance from a center of a window to a predetermined distance and wherein said weighting coefficients monotonously decrease from said predetermined distance to an edge of said window.

5. The apparatus as claimed in claim 2, wherein said averaging circuit weights said strength signal in each of said time windows with weighting coefficients which are constant as a function of time distance from a center of a window to a predetermined distance and wherein said weighting coefficients monotonously decrease from said predetermined distance to an edge of said window.

6. The apparatus as claimed in claim 1, further including width setting means coupled to said averaging circuit for setting a temporal width of one of said time windows dependent on a pitch of said speech signal.

7. The apparatus as claimed in claim 6, wherein said width setting means sets the width of one of said time windows to a time range selected from one of a first time range and a second time range, said first time range including between about 1 millisecond and 5 milliseconds and said second time range including from between about 5 milliseconds and 10 milliseconds.

8. The apparatus as claimed in claim 1, wherein said filter copies a further spectral fraction of said speech signal above about 1 kHz into said filtered speech signal.

9. The apparatus as claimed in claim 2, further including a further averaging circuit for determining an average DC content of said strength signal, averaged over a temporal extent wider than the width of one of said windows and threshold means coupled to said further averaging circuit for determining whether said time dependent intensity of said speech signal exceeds the average DC content of said strength signal by more than a predetermined value.

10. The apparatus as claimed in claim 1, further including vocal tract simulation means coupled to said detection means for forming a synthesized speech signal.

11. The apparatus as claimed in claim 1, further including selection means coupled to said averaging circuit for selecting the temporal width of the time windows.

* * * * *